US008613202B2

(12) United States Patent
Williams

(10) Patent No.: US 8,613,202 B2
(45) **Date of Patent: *Dec. 24, 2013**

(54) INSULATED SHIPPING CONTAINER SYSTEMS AND METHODS THEREOF

(76) Inventor: Alton Williams, Miami, FL (US)

( * ) Notice: Subject to any disclaimer, the term of this patent is extended or adjusted under 35 U.S.C. 154(b) by 769 days.

This patent is subject to a terminal disclaimer.

(21) Appl. No.: 12/697,809

(22) Filed: Feb. 1, 2010

(65) Prior Publication Data

US 2010/0147837 A1 Jun. 17, 2010

Related U.S. Application Data

(63) Continuation of application No. 11/105,541, filed on Apr. 14, 2005, now Pat. No. 7,681,405.

(51) Int. Cl.
*F25D 3/14* (2006.01)

(52) U.S. Cl.
USPC ..... 62/60; 62/384; 62/457.2; 220/592.2

(58) Field of Classification Search
USPC ..... 62/62, 457.2; 220/23.83, 23.87, 918, 220/919
See application file for complete search history.

(56) References Cited

U.S. PATENT DOCUMENTS

| | | | | |
|---|---|---|---|---|
| 652,492 | A | | 6/1900 | Stuart |
| 2,289,060 | A | | 7/1942 | Merkle |
| 2,632,311 | A | | 3/1953 | Sullivan |
| 3,410,109 | A | | 11/1968 | Maryland |
| 4,145,895 | A | | 3/1979 | Hjertstrand et al. |
| 4,294,079 | A | | 10/1981 | Benson |
| 4,576,017 | A | | 3/1986 | Combs et al. |
| 4,845,957 | A | | 7/1989 | Richardson |
| 4,862,674 | A | | 9/1989 | Lejondahl et al. |
| 4,903,493 | A | | 2/1990 | Van Iperen et al. |
| 5,355,684 | A | | 10/1994 | Guice |
| 5,417,082 | A | * | 5/1995 | Foster et al. ..... 62/457.1 |
| 5,435,142 | A | | 7/1995 | Silber |
| 5,669,233 | A | | 9/1997 | Cook et al. |
| 5,697,500 | A | | 12/1997 | Walker |
| 5,897,017 | A | | 4/1999 | Lantz |
| 5,924,302 | A | | 7/1999 | Derifield |
| 5,983,661 | A | | 11/1999 | Wiesman |
| 6,003,706 | A | | 12/1999 | Rosen |
| 6,189,330 | B1 | | 2/2001 | Retallick et al. |
| 6,209,343 | B1 | | 4/2001 | Owen |
| 6,666,032 | B1 | | 12/2003 | Rickson et al. |
| 6,968,711 | B2 | * | 11/2005 | Smith et al. ..... 62/371 |
| 2005/0006272 | A1 | | 1/2005 | Derifield |
| 2006/0191282 | A1 | | 8/2006 | Sekiya |
| 2006/0230778 | A1 | | 10/2006 | Williams |

OTHER PUBLICATIONS

Brochure entitled "THERMOshipping by STOROpack" 2010 from http://www.storopack.com/fileadmin/user_upload/6_Download/Brochures/Thermoshipping_english_2010_mail.pdf.

* cited by examiner

*Primary Examiner* — Cheryl J Tyler
*Assistant Examiner* — David Teitelbaum
(74) *Attorney, Agent, or Firm* — Kristina Castellano; Castellano PLLC

(57) ABSTRACT

An insulated shipping container system for transferring a temperature sensitive product comprising a substantially hollow insulated body having inner walls and outer walls defining a payload cavity to receive a payload and supports to space the payload from the insulated body thereby defining an internal air filled space to facilitate heat transfer. The insulated shipping container system further comprises a heat transfer element cavity configured to receive a heat transfer element and supports to space the heat transfer element from the insulated body thereby defining an internal air filled space to facilitate heat transfer. Also provided are methods for shipping temperature sensitive products and goods comprised of packing and assembling the insulated shipping container system disclosed herein.

8 Claims, 9 Drawing Sheets

SECTION 8-8

INSULATED SHIPPING CONTAINER SYSTEMS AND METHODS THEREOF

CROSS-REFERENCE TO RELATED APPLICATION

The present patent document is a continuation of U.S. patent application Ser. No. 11/105,541, filed on Apr. 14, 2005, the entire contents of which are incorporated herein by reference

BACKGROUND OF THE INVENTION

1. Field of the Invention

The present invention relates to a shipping container, and more particularly insulated shipping containers, used to ship temperature sensitive goods and products. The present invention also relates to methods of assembling, packing, and shipping goods and products in insulated shipping containers.

2. Background of the Related Art

Insulated shipping container systems are used to transport a variety of temperature sensitive products and goods including, for example, biological products, perishable foodstuffs, and raw materials. The thermal objective for a container system is to maintain a predetermined temperature range to protect the payload, i.e., the product being shipped from experiencing harmful external environmental temperature fluctuations, where the two most basic components are refrigerant and thermal insulation. Typical insulated shipping container systems attempt to maintain a predetermined temperature, whether cooled or heated, and attempt to insulate the payload, i.e. the product being shipped, from experiencing external environmental temperature fluctuations.

Biological products such as blood, biopharmaceuticals, reagents and vaccines with registered storage refrigeration conditions are commonly transported using insulated shipping containers. Because of these products' susceptibility to the external environmental temperature, increased regulatory scrutiny of product transport conditions have been implemented to ensure the viability of the product being shipped. Accordingly, shippers have had to make costly upgrades to their container systems to ensure compliance.

Current insulated shipping container systems use insulating material to protect the payload from external environmental temperatures. In addition, the insulating material protects the internal temperature from external temperature fluctuations. Typical insulating materials include expanded polystyrene and/or rigid polyurethane.

Current industry consensus is that high performance thermal insulation will remedy compliance requirements. This is in no way an assurance nor is it pragmatic. In order to combat increasing regulatory scrutiny and keep cost at a minimum and maximize functionality, future container systems must perform more efficiently using conventional materials. Thermal insulation is essential in protecting payloads from their thermal environment, but they do very little in keeping payloads cool. Instead, refrigerants and their use must be improved to achieve maximum efficiency.

Payloads are typically cooled using refrigerants that reside in the interior cavity formed by the insulating material. Refrigerants most typically used include ice, dry ice, gel packs, foam refrigerant, and the like. In conventional container systems cooling between refrigerant and payload is achieved by direct contact between refrigerants and payload. Chilled refrigerant is placed between subzero (OC) frozen refrigerant and payload. The frozen and chilled refrigerant now forms a refrigerant system. The payload temperature is regulated by adjusting the amount and surface-to-surface contact of the chilled refrigerant onto the payload in conjunction with adjusting the amount and surface-to-surface contact of the frozen refrigerant onto the chilled refrigerant. The most functional configuration for shippers using this method is to locate the refrigerant system above the payload in contact with a single payload surface. This particular configuration is most effective in distributing small payloads and has limited cooling capacity and lack uniform cooling due to the limited contact between the refrigerant system and payload. This configuration must be abandoned when considering larger payloads and/or greater cooling. In order for this method to accommodate large payloads and/or greater cooling the refrigerant system must be expanded across additional payload surfaces, subsequently adding considerable weight to the container system and reducing functionality. Added weight and burden translates to increased cost. Ineffective refrigerant migration is another fault with this method, increasing the risk of failure. In addition, current insulated shipping containers have seams that are susceptible to air leaks, thereby negatively impacting the insulating properties of the insulating materials and reducing the efficiency of the refrigerant.

Recent attempts to improve typical insulated shipping containers have met with mixed success. In one example, an insulated shipping container is provided whereby the refrigerant is placed on a tray, separate from the payload. See, e.g. U.S. Pat. No. 4,576,017 to Combs et al., incorporated herein by reference. While this design attempts to minimize the problems associated with putting the refrigerant in direct contact with the payload, the efficiency of the refrigerant is reduced requiring the use of more refrigerant to achieve a desired cooling effect, adding to the overall cost of these types of insulation shipping containers. In addition, the insulating properties of the refrigerant supporting tray further reduce the cooling properties of the refrigerant, requiring the use of more refrigerant and lower minimum refrigerant operating temperatures to achieve the desired cooling temperature, which in turn may lead to damage to the payload. Similarly, the '017 patent discloses attempts to increase the convective cooling that takes place inside the cavity of the shipping container by creating grooves, channels, or protrusions to increase the air flow around the payload. The designs of this and other systems, however, continue to have deleterious effects, especially with respect to the base or bottom of the payload, as there is sufficient contact between the payload and protrusions in these systems which in turn reduce air flow around critical parts of the payload, leading to uneven cooling of the payload. Furthermore these designs continue to be costly, difficult to construct, not scalable, and not capable of being a part of a pre-packaging or automated packaging system.

In order to combat increasing regulatory scrutiny and keep cost at a minimum and maximize functionality, future container systems must perform more efficiently using conventional materials. Accordingly, there is a need for improved shipping containers and systems to provide cost effective, scalable, and workable solutions demanded by the extreme requirements of shipping temperature sensitive goods and products.

SUMMARY OF THE INVENTION

The present invention is generally directed to an improved insulated shipping container for shipping temperature sensitive goods and products in a refrigerated state for an extended period of time. The container system uses conventional materials arranged in a modular fashion to keep a payload cool by transferring heat from the payload to the refrigerant using the air filled space surrounding the payload and a heat transfer element, e.g. a refrigerant, as the heat transfer mechanism. During the heat transfer process the heat transfer element, or refrigerant, is in a frozen state in the process of phasing. Thus, the refrigerant phasing temperature is the refrigeration temperature for the insulated shipping container system since in the present invention the air internal to the shipping container is in contact with most of the surface area of the refrigerant and payload. Because the amount of heat transferred to or from a body is directly proportional to its surface area, the present invention increases cooling efficiency and allows higher minimum operating refrigerant temperatures, which in turn directly reduces costs, risks of failure, and improves uniform cooling. The present invention contemplates regulating the payload temperature by varying the refrigerant phasing temperature and/or varying the surface area of the refrigerant. This aspect of the invention reduces design, development and implementation cost.

Generally, the shipping container system includes a base container created to form a cavity to hold a payload carton. The container system also includes a refrigerant collar configured to create a cavity in which refrigerant may be placed. The present invention contemplates that the base container and refrigerant collar may be shaped to allow these two components of the container system to lock or join together in a substantially tight fit. The container system also includes a lid to close the open end of the base container and refrigerant collar assembly, or alternatively the refrigerant collar and lid may be made as one unit. Where the lid is a separate piece, the lid may similarly include a cooperative fit design, such as tongue and groove joints, to create an interference fit with the refrigerant collar. The components of the present invention may each be made of a single molded part made of expanded polystyrene or other insulating material such as polyurethane. In one embodiment, when assembled the components form a six-sided orthogonal insulated container.

In a first preferred embodiment in accordance with the present invention, the container system includes a substantially rectangular insulated base container comprised of five sidewalls (one bottom sidewall and four side sidewalls) and an open top. The base container preferably is made with base container supports to suspend the payload from the sidewalls of the base container.

The container system also includes a refrigerant collar that is used to hold the refrigerant. The collar preferably contains refrigerant supports to maintain the refrigerant suspended and/or spaced from the payload. The refrigerant collar is preferably designed with cooperating joints, such as tongue and groove, such that the collar and base container can fit together in a substantially sealed manner. The container system, in this embodiment, also includes a lid to cover the open refrigerant collar top. As with the base container, the lid is comprised of a cooperating fit with the refrigerant collar, such as tongue and groove, to substantially seal the lid and refrigerant collar.

When assembled, the payload is suspended from and spaced from the sidewalls of the base container creating an air filled space around the payload, which is used as the heat transfer mechanism. Additionally, the refrigerant is suspended above the payload, with substantially all of the refrigerant's surface area exposed to the air filled space such as to maximize efficiency of the heat transfer. The cooperating fit employed in the design of this preferred embodiment results in a substantially sealed container system protecting the payload from external temperatures. While the assembled base container, payload, refrigerant collar, and lid may be shipped as assembled, the components are preferably placed inside a closure carton such that the closure carton substantially surrounds the assembled components.

The present invention's design maximizes the use of heat transfer principles, i.e. convection and conduction, resulting in certain advantages including the ability to use less refrigerant per payload volume or payload weight. In addition, the design and methods of the present invention reduce the overall weight of the container system and, in turn, allows shippers to increase the amount of payload being shipped. The design and methods of the present invention also lead to increased uniformity in the cooling of the payload. The present invention also provides for the use of a single state refrigerant. Alternatively, the closure method can be taping, strapping, shrink wrapping or other closure methods known to those of skill in the art.

The present invention's modular design provides for simple construction, increasing shipping efficiency and desirability of the system. By providing a modular design, the container system lends itself to use in automated and manual distribution processes. The present invention additionally provides advantages in the ability to pre-pack payload and refrigerants in separate phases of a distribution process and allows shippers to use a variety of different refrigerant types and sizes. Additionally, the present design and methods reduce the ineffective migration of payload and refrigerant.

Additional features and advantages of the present invention may be appreciated from a reading of the detailed description of several particularly preferred exemplary embodiments of the invention, taken in conjunction with the figures.

BRIEF DESCRIPTION OF THE DRAWINGS

The Detailed Description will be best understood when read in reference to the accompanying figures wherein.

DETAILED DESCRIPTION OF THE PREFERRED EMBODIMENTS

The preferred embodiments of the invention will now be described with reference to the attached drawing figures. The following detailed description of the invention is not intended to be illustrative of all embodiments. In describing exemplary embodiments of the present invention, specific terminology is employed for the sake of clarity. However, the invention is not intended to be limited to the specific terminology so selected. It is to be understood that each specific element includes all technical equivalents that operate in a similar manner to accomplish a similar purpose.

As used herein, "spacer" or "support" refers to any part of the container system that spaces a payload or refrigerant from the sidewalls of a container and/or other components of the shipping container system. As used herein, a spacer or support may be an "L" shaped structure or made of another design so long as the spacer performs the function of supporting and/or holding a payload or refrigerant a predetermined space apart from another component of the container system, e.g. the base container, collar, or sidewalls. The spacer is designed such that substantially all of the surface area of the payload or refrigerant is exposed to the internal air filled space of the container system.

As used herein, "container system" includes insulated shipping containers and shipping containers.

As used herein, cooperating fit refers to the junction of two components wherein the design of the components is made such that an area of one component to another comes in substantially solid contact with the junction area of a second component. Cooperating fit includes a tongue and groove junction and may also refer to a junction in which the surface area of the junction of the two components is substantially flat.

Figure 1:
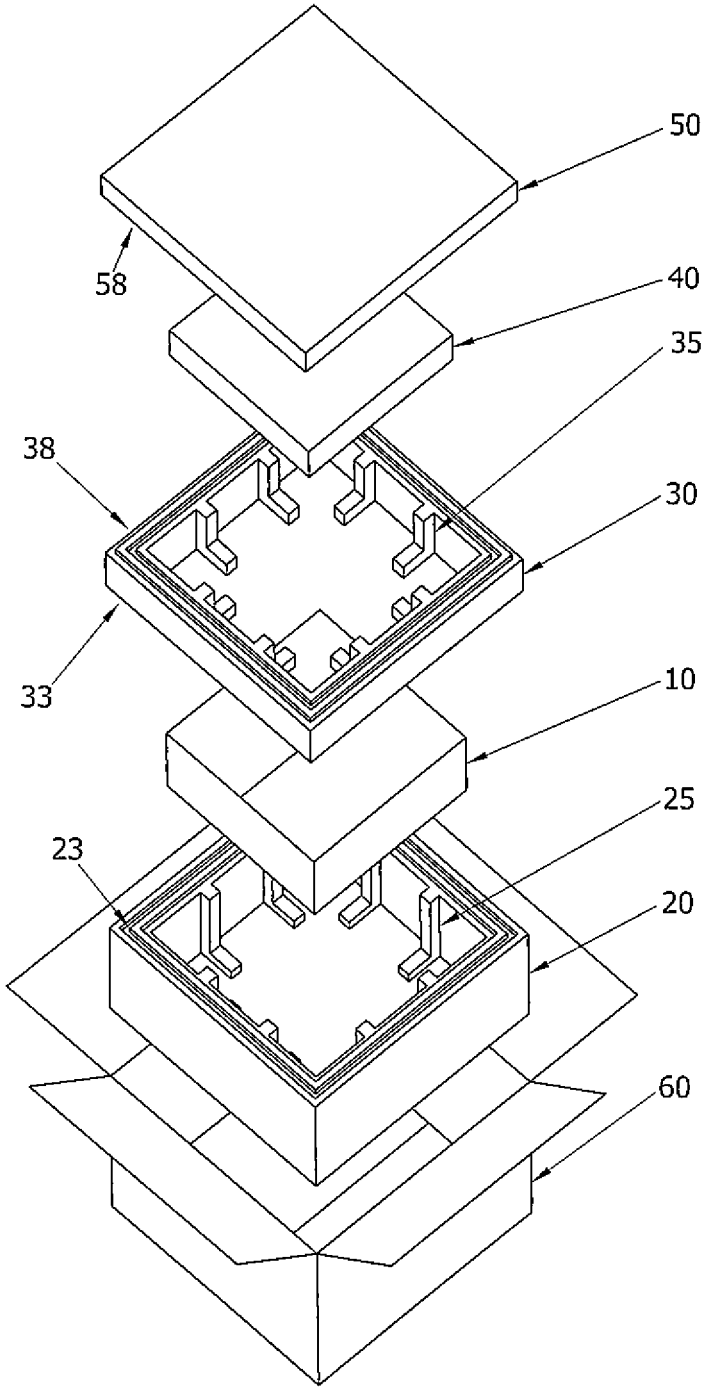
FIG. 1 is an exploded perspective view of one of the preferred embodiments of the container system.
Figure 2:
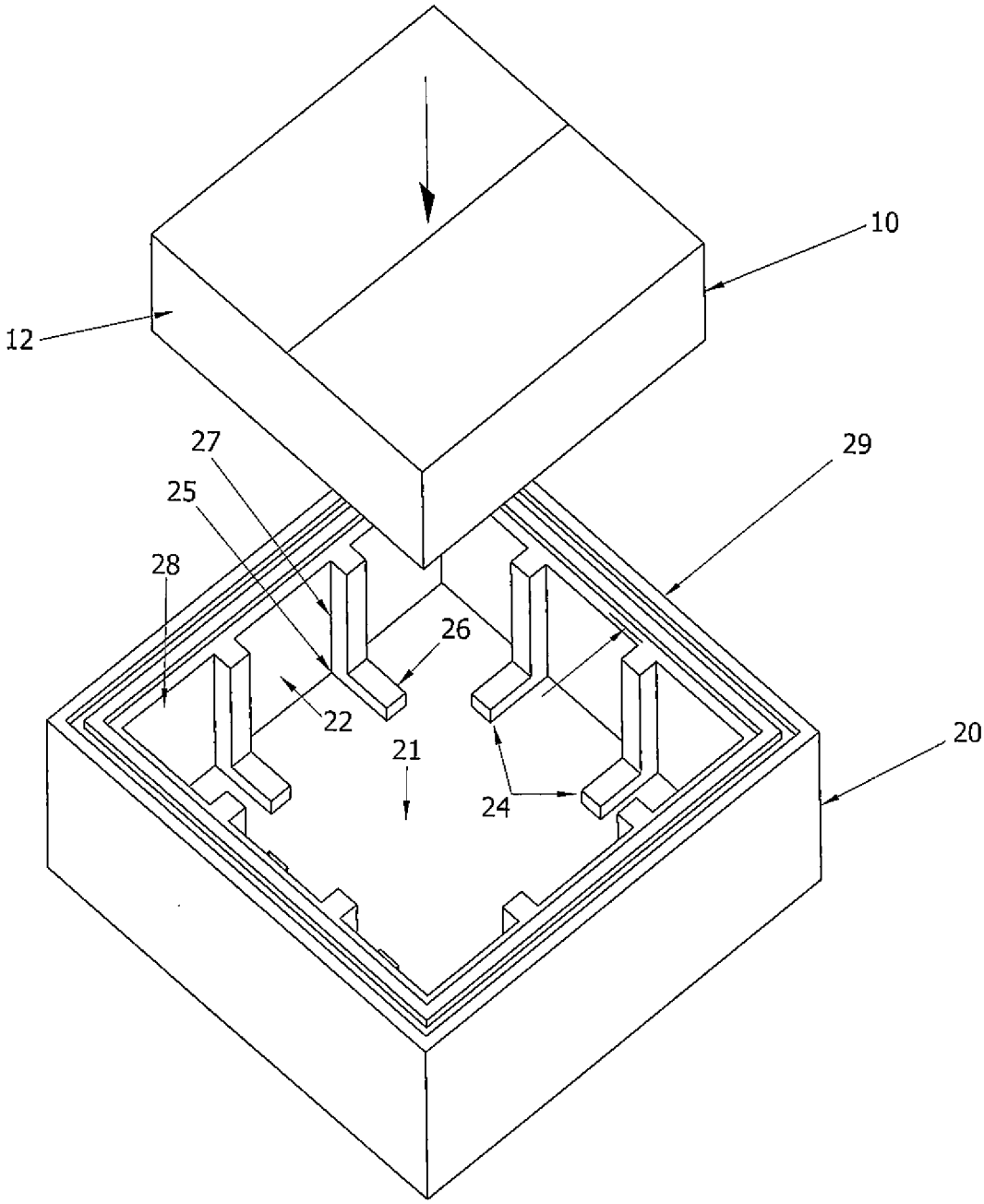
FIG. 2 is an exploded view of the base container and payload of a preferred embodiment.

With reference to FIG. 1, a preferred embodiment is shown of a container system with its components, including a payload 10, base container 20, refrigerant collar 30, refrigerant 40, lid 50, and closure carton 60. With reference to FIGS. 1 and 2, the base container 20 is a substantially rectangular container made from an insulating material. The base container 20 is comprised of five sidewalls, bottom sidewall 21 and four side sidewalls 22. The base container 20, in this embodiment, contains eight base container supports 25, two supports to each sidewall 22. In this particular embodiment, the base container supports 25 are comprised of a base 26 and stem 27 (shown in FIG. 2). The bases 26 of the base container supports 25 serve to elevate or suspend the payload above the bottom wall 21 of the base container 20. The stems 27 serve to separate the payload 10 from the four sidewalls 22. The bases 26 of the base container supports 25 are designed such that a space is formed between the bottom 21 of the base container 20 and the bottom of the payload 10, creating an air filled space 24 (shown in FIG. 2). In this preferred embodiment the bases 26 of the base container supports 25 are designed to minimize the amount of contact the bases 26 of the base container supports 25 have with the payload 10 such that substantially all of the surface area of the payload 10 is exposed to the air while still providing stability and physical support to the payload. The stems 27 of the base container supports are designed such that a space is formed between the sidewalls 22 of the base container 20 and the sidewalls 12 (shown in FIG. 2) of the payload 10, creating an air filled space 28 (shown in FIG. 2). In this preferred embodiment the stems 27 of the base container supports 25 are designed to minimize the amount of contact the stems 27 of the base container supports 25 have with the payload 10 such that substantially all of the surface area of the payload 10 is exposed to the air.

It has been found that by increasing the surface area of the payload and refrigerant exposed to the internal air filled space of the shipping system, increased cooling efficiency is achieved. In this particular embodiment, approximately at least 85% of the payload surface area is exposed to air. Similarly, in this embodiment approximately at least 90% of the refrigerant surface area is exposed to air. While no specific limitation is intended by the recitation of the percent of surface area exposed to the air, it has been found that once approximately at least 50% of the surface area of either or both the payload and refrigerant surface area is exposed to the air, the shipping system displays cooling characteristics far superior to other passive cooling systems. In a preferred embodiment, at least 75% of the surface area of either or both the payload and refrigerant is exposed to the air.

FIGS. 1 and 2 similarly show one half of the cooperating fit of the base container 20, namely the tongue and groove design of the base container 20. The cooperating fit in this preferred embodiment is designed such that the base container 20 contains a tongue and groove joint 23 that fits the tongue and groove joint 33 of the refrigerant collar creating a substantially sealed fit to minimize air leakage and heat transfer with the external environment.

With continued reference to FIGS. 1 and 2, a payload 10 is shown wherein the payload 10 can be located within the cavity formed by the walls of the base container 20. The payload 10 and base container 20 are designed so that the base container supports 25 are in contact with the payload 10 such that the payload 10 is separated from the base container sidewalls 22 and bottom 21. In a preferred embodiment, the payload 10 may be a payload carton comprised of an E-flute RSC container. In other embodiments, the payload is a container comprised of another material that enhances heat transfer or alternatively the payload is the good or product being shipped without a container.

Figure 3:
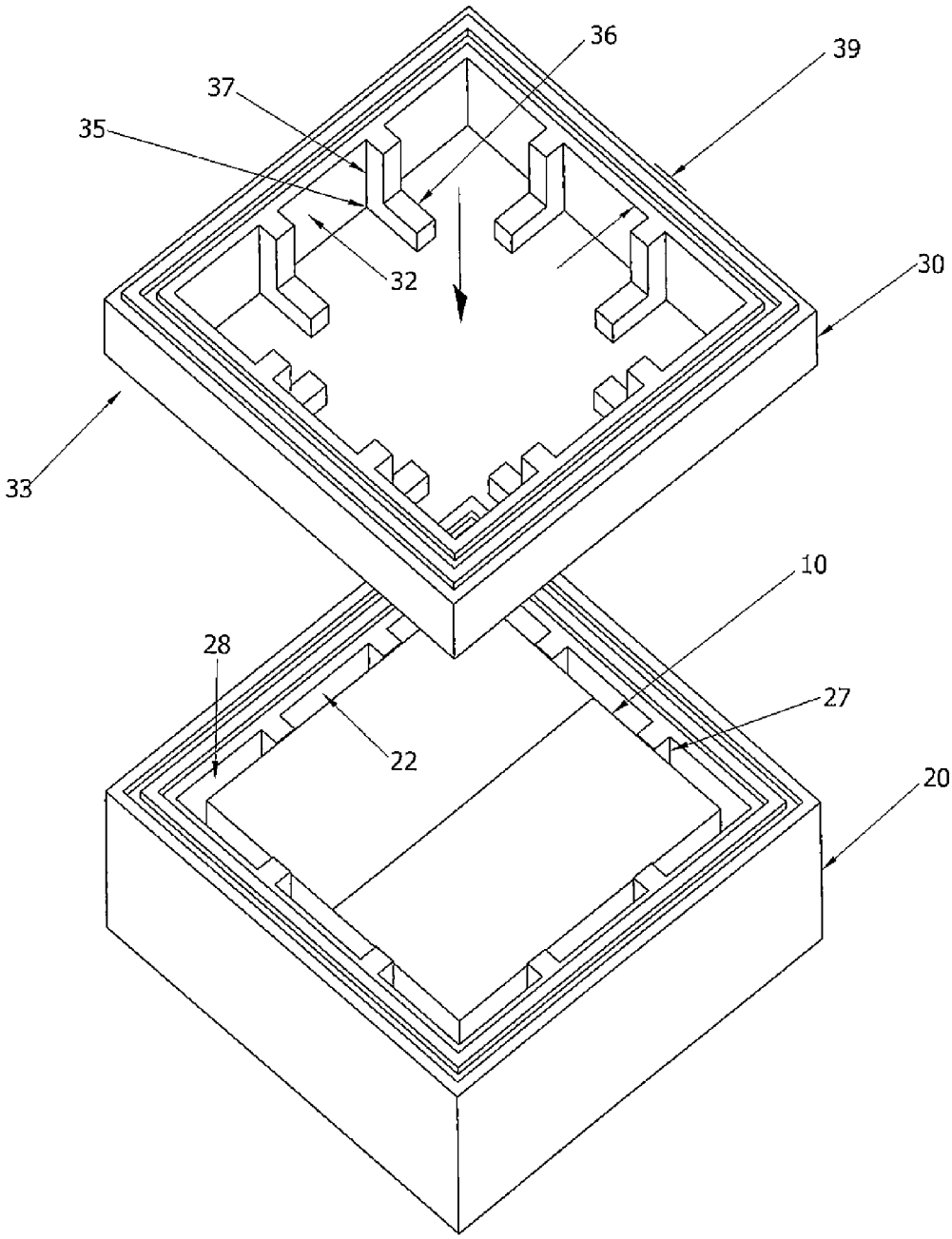
FIG. 3 is an exploded view of the base container, payload, and refrigerant collar of a preferred embodiment.

With reference to FIGS. 1 and 3, the container system is shown with the payload 10, base container 20, and refrigerant collar 30 components. In FIG. 3, the refrigerant collar 30 is shown being joined with the base container 20. The refrigerant collar 30 and base container 20 are joined using a cooperative fit, which in this embodiment takes the form of a tongue and groove joint. In this embodiment, the tongue and groove joints 38 and 33 are molded into the perimeter surfaces created by the wall thickness 39 at each open end of the refrigerant collar 30. The refrigerant collar 30 is designed to hold or support the refrigerant (not shown) of the container system. In this embodiment, the refrigerant collar 30 is comprised of eight inner "L" shaped refrigerant supports or spacers 35 comprised of bases 36 and stems 37 with two refrigerant supports 35 being placed on each side of the four refrigerant collar sidewalls 32. The width and location of the refrigerant collar supports 35 are configured to minimize contact with the refrigerant (not shown), while providing affordable stability and physical support to the refrigerant. The refrigerant collar supports 35 are also designed to suspend the refrigerant above the payload 10 to create an air filled space between the refrigerant 40 and payload 10. By ensuring that the surface area of the refrigerant exposed to the air is substantial, the design maximizes the use of heat transfer principles to efficiently maintain a desired temperature range.

FIG. 3 also shows the air filled space 28 created by the base container stems 27 between the base container' sidewalls 22 and payload 10 after insertion of the payload 10 into the base container 20.

Figure 4:
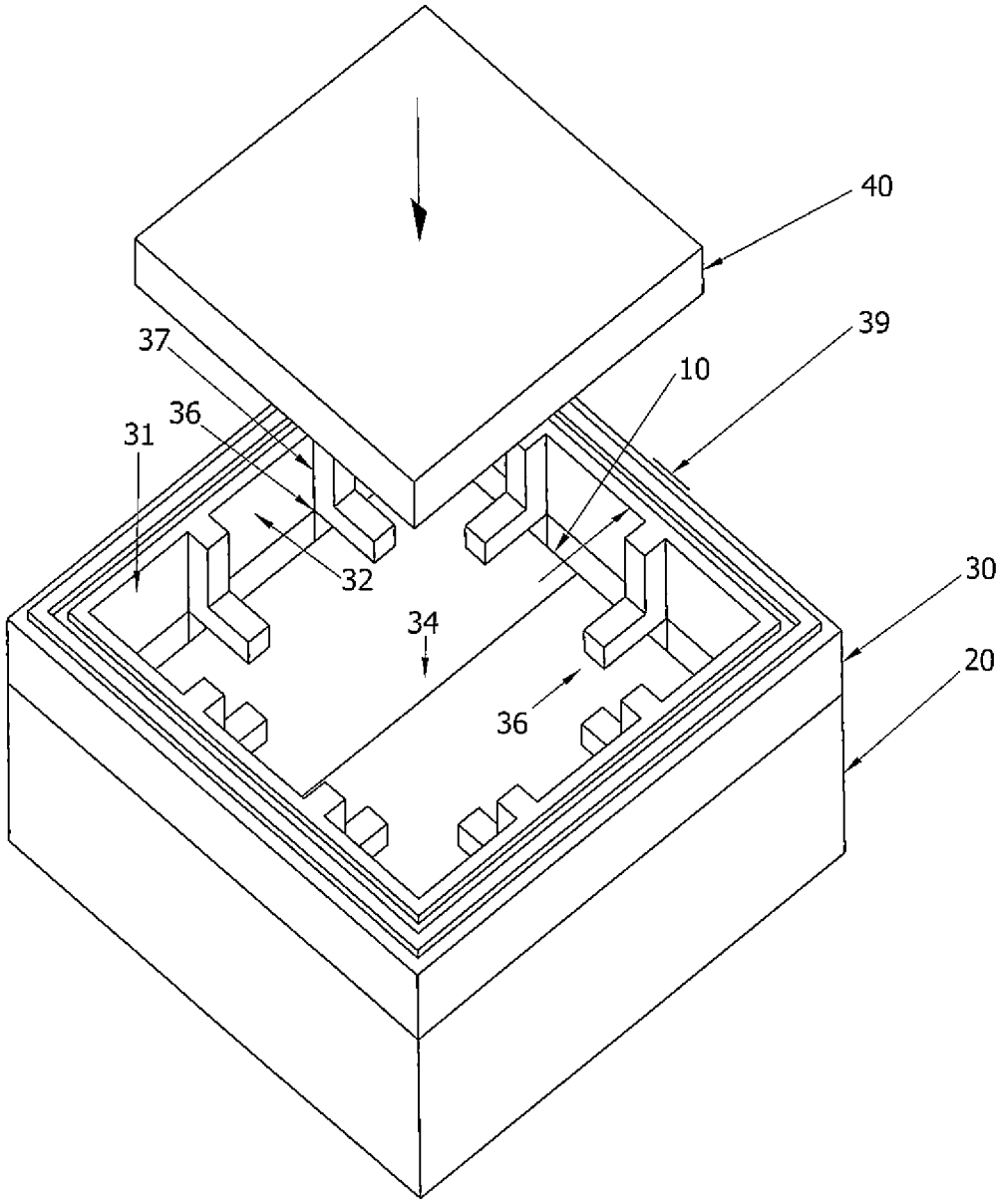
FIG. 4 is an perspective view of a preferred embodiment wherein the base container, payload, and refrigerant collars have been assembled and includes a view of the refrigerant being assembled into the refrigerant collar.

With reference to FIGS. 1 and 4, the refrigerant 40 can be placed within the refrigerant collar 30. FIG. 4 is an exploded view of the refrigerant 40 being placed into the refrigerant collar 30. In a preferred embodiment, the refrigerant 40 is rigid and can support its own weight, whether the refrigerant 40 is in a frozen or unfrozen state. The various types of refrigerant that contain these properties are commonly known and used throughout the industry. The refrigerant collar stems 37 of the refrigerant collar supports 35 space the refrigerant 40 a specific distance from the four sidewalls 32 of the refrigerant collar 30 creating air filled space 31 between the four sidewalls 32 of the refrigerant collar 30 and the refrigerant 40. The refrigerant collar bases 36 of the refrigerant collar supports 35 space the refrigerant 40 a specific distance above the payload 10 when the base container 20 and refrigerant collar 30 are joined, creating air filled space 34 between the refrigerant 40 and the payload 10. The refrigerant collar supports 35 are designed such that substantially all of the surface area of the refrigerant 40 is exposed to the internal air of the shipping container. In this embodiment of the present invention, a single refrigerant is used. FIG. 4 also shows the tongue and groove joint 38 created from the wall thickness 39 of the refrigerant collar 30.

Figure 5:
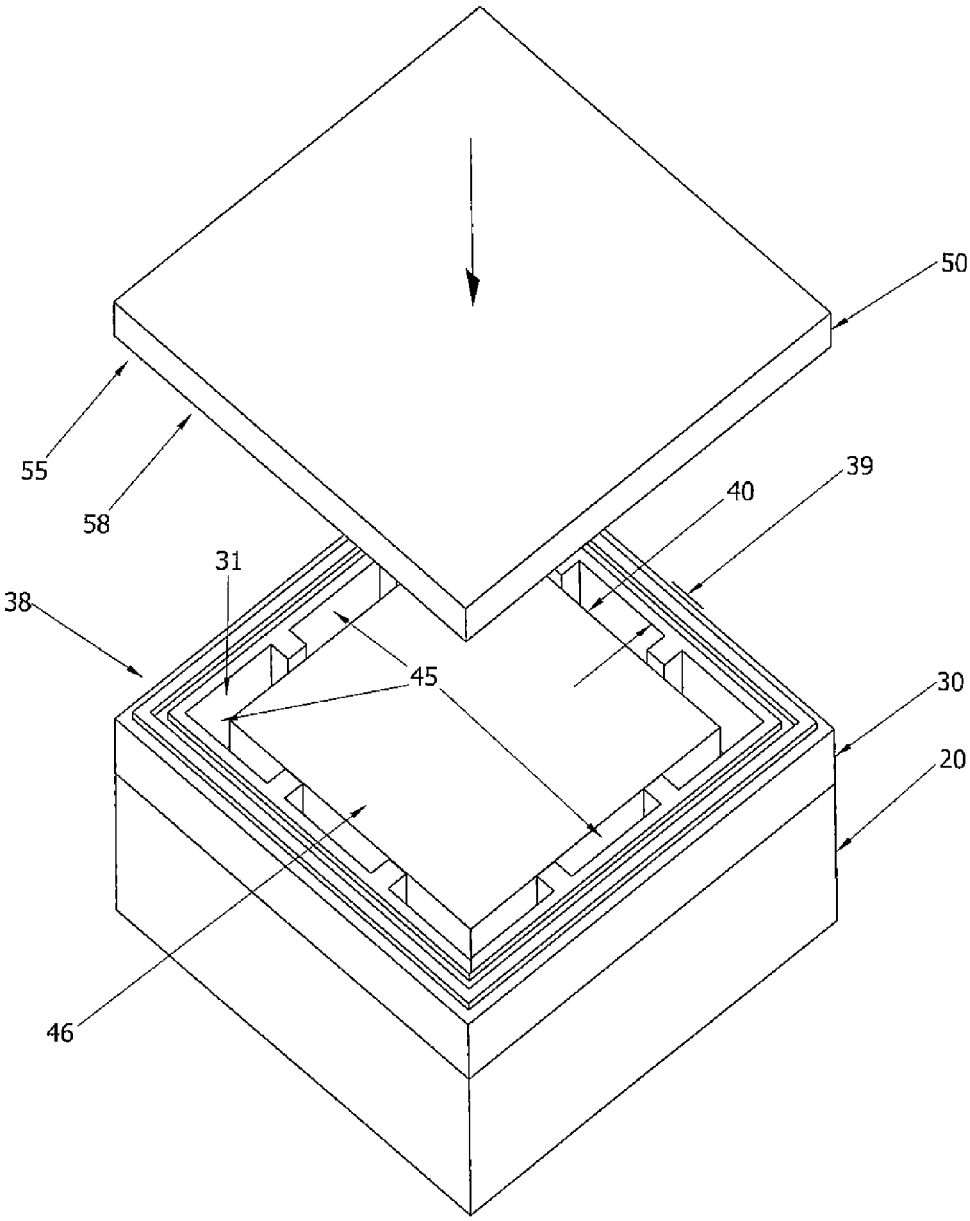
FIG. 5 is a perspective view of a preferred embodiment wherein the lid is being placed onto the assembled components of the container system.

With reference to FIGS. 1 and 5, the lid 50 is shown. The lid 50 component caps the insulated container system. In one embodiment, the cooperative fit of the container system includes a tongue and groove junction. FIG. 5 shows the cooperative fit of the tongue and groove junction of the refrigerant collar 30 created from the wall thickness 39 of the refrigerant collar 30. The tongue and groove junction 58 of the lid 50 cooperatively fits with the tongue and groove junction 38 of the refrigerant collar 30. Tongue and groove joint 58 is not visible in FIG. 5. FIG. 5 also shows how in this particular embodiment, an air filled space 45 is created between the top surface 46 of the refrigerant 40 and the bottom surface 55 of the lid 50.

Figure 6:
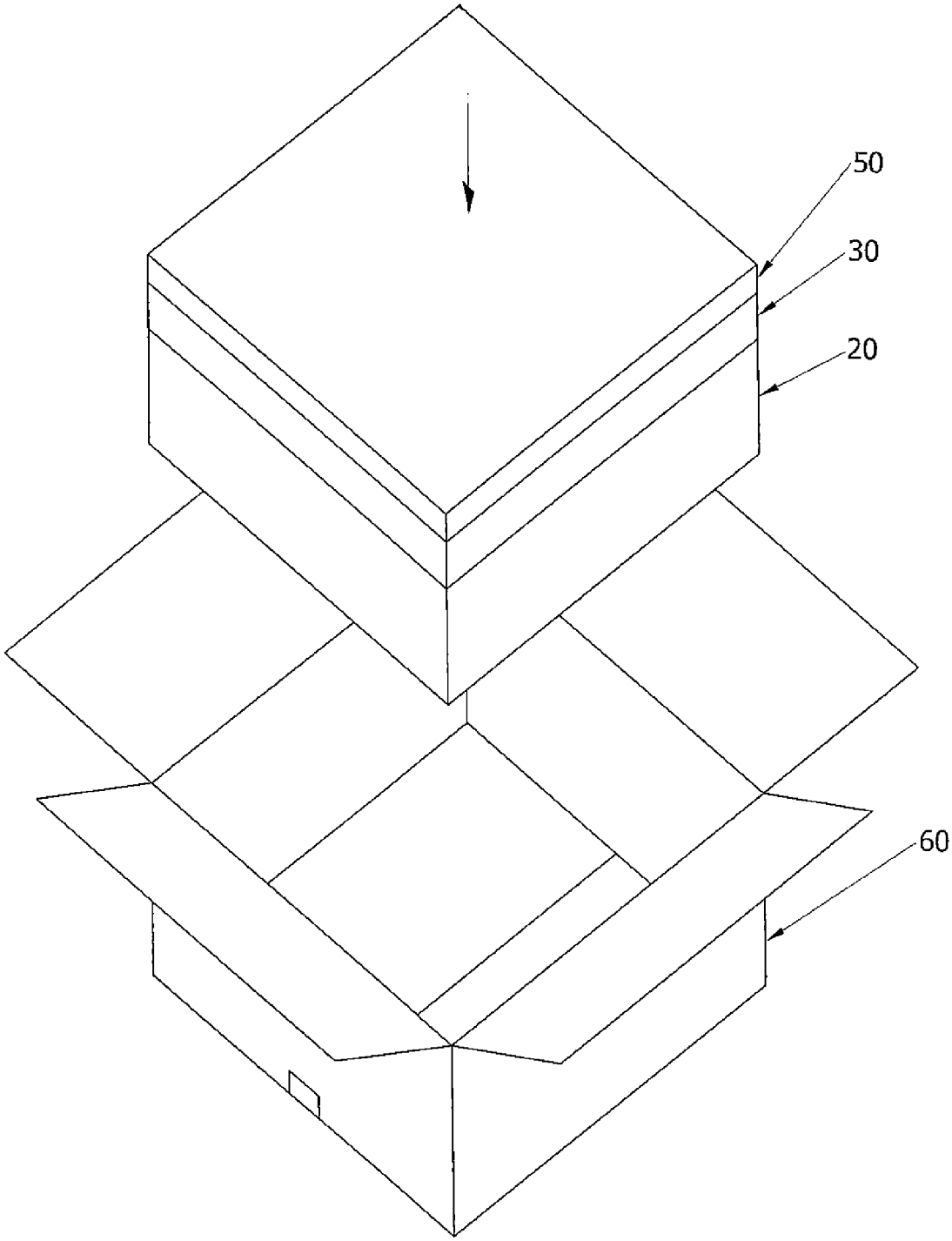
FIG. 6 is a perspective view showing a preferred embodiment wherein the assembled components are enclosed with a closure carton.

With reference to FIG. 6, the closure method of the container system ensures that other components of the container system do not become open during shipping. In FIG. 6, the container system closure method is an RSC corrugate closure carton 60, which is taped closed. In FIG. 6, the payload component 10 (not visible), base container component 20, refrigerant collar component 30, refrigerant component 40 (not visible), and lid component 50, are assembled and are being placed into the closure carton 60. In alternative embodiments, any closure method known to those skilled in the art may be used.

Figure 7:
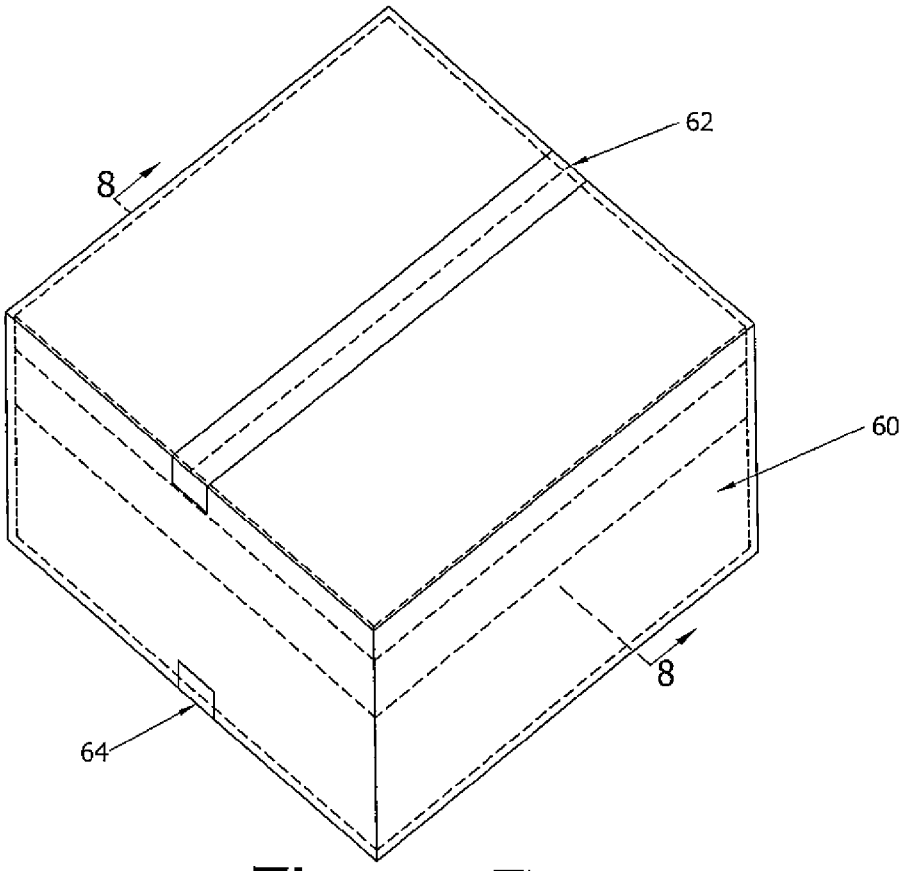
FIG. 7 is a perspective view of a preferred embodiment fully assembled.

FIG. 7 is a perspective view of the fully assembled insulated shipping container system with the top seam 62 and bottom seam 64 of the closure carton 60 taped closed.

Figure 8:
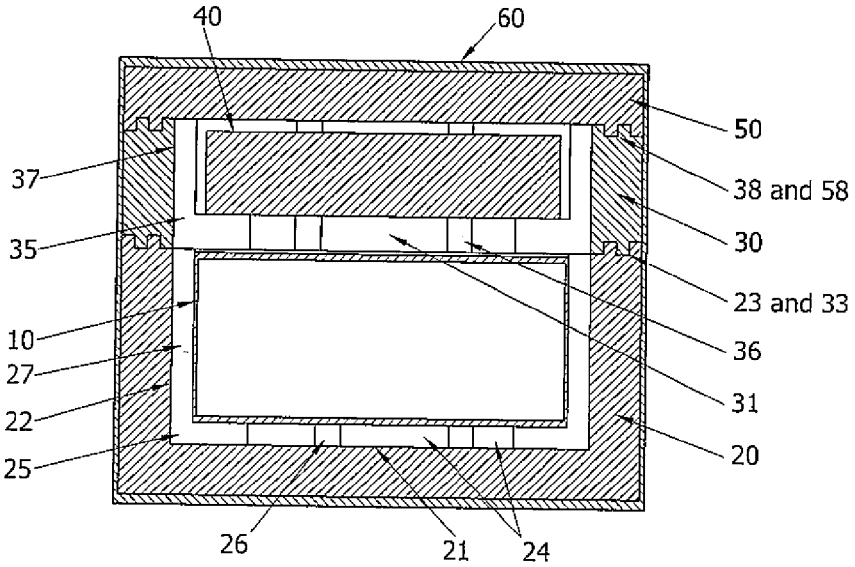
FIG. 8 is a cross section view of FIG. 7 taken along 8-8.

FIG. 8 is a cross sectional view of a preferred embodiment of a container system taken along the axis 8-8. In FIG. 8, the container system is shown assembled comprising a payload 10, base container 20, refrigerant collar 30, refrigerant 40, lid 50, and closure method 60. As can be seen in FIG. 8, the supports and spacers of the components of the container system create air filled space cavities. FIG. 8 shows, in particular, the air filled spaces 24 created by the bases 26 of the base container supports 25 and the air filled spaces 31, created by the bases 36 of the refrigerant collar supports 35. These air filled spaces as well as those created by stems 27 and 37 of the base container supports 25 and refrigerant collar supports 35, respectively, allow for the efficient use of heat transfer principles to cool the payload. In addition, FIG. 8 shows another aspect of the present invention, namely that the refrigerant 40 is physically restrained within the refrigerant collar but remains subject to small amounts of movement. In a preferred embodiment, the movement retained by the refrigerant 40 increases the heat transfer between the refrigerant 40 and surrounding air as the refrigerant 40 actively moves the air in contact with the refrigerant 40 during handling of the container system thereby increasing the efficiency of the heat transfer principle employed by the invention.

Where it is desired to cool a payload using the heat transfer principle of free convection, the container system must be orientated such that the refrigerant 40 is suspended above the payload 10. In this scenario, the air in contact with the surfaces of the phasing refrigerant 40 becomes denser than the air in contact with the surfaces of the payload 10. The denser cooler air descends due to gravity and the less dense warmer air ascends forming a cooling current with respect to the payload. This represents the optimum orientation for cooling the payload 10 using free convection as the heat transfer principle. In other orientations heat transfer is primarily by conduction, e.g. when the container is turned on its side.

As described previously, movement of the refrigerant 40 within its supports as a result of handling during distribution can further enhance cooling of the payload 10 by actively moving the air in contact with the refrigerant 40. Accordingly, the design, size, type of refrigerant 40 used may all be varied to maximize the use of this feature of the invention while maintaining the stability and support of the refrigerant 40.

Figure 9:
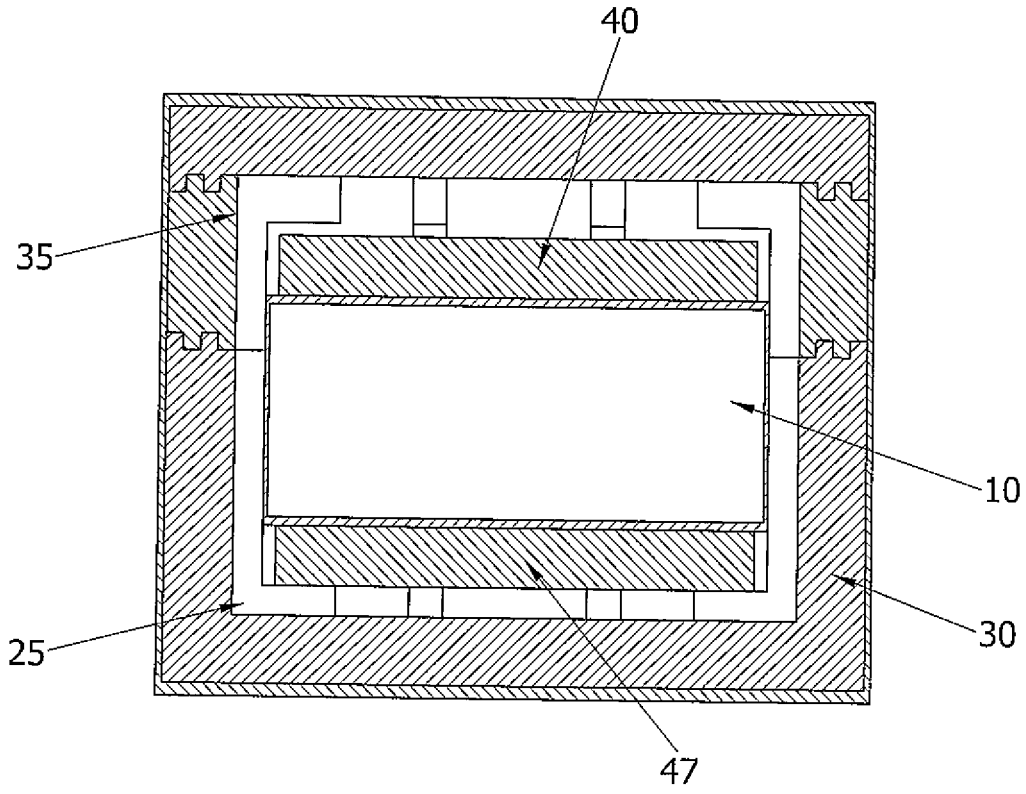
FIG. 9 is a cross sectional view of FIG. 7 taken along 8-8 where the refrigerant collar is inverted.

In addition to cooling the payload, the present invention can protect payloads from becoming too cold in the case of shipments made during winter or in extremely cold environments. With reference to FIG. 9, the container system may be placed in an orientation where the refrigerant collar 30 is inverted. In this embodiment, the refrigerant 40 is typically the same temperature as the payload 10. FIG. 9 also shows the use of a second refrigerant 47 placed underneath the payload 10. In this embodiment, the payload 10 and refrigerants 40 and 47 are encapsulated with air filled space created by the base container supports 25 and refrigerant collar supports 35. This arrangement limits the amount of heat liberated by the container system. Alternative arrangements (not shown) include the use of one or more refrigerant collars in any number of orientations.

Figure 10:
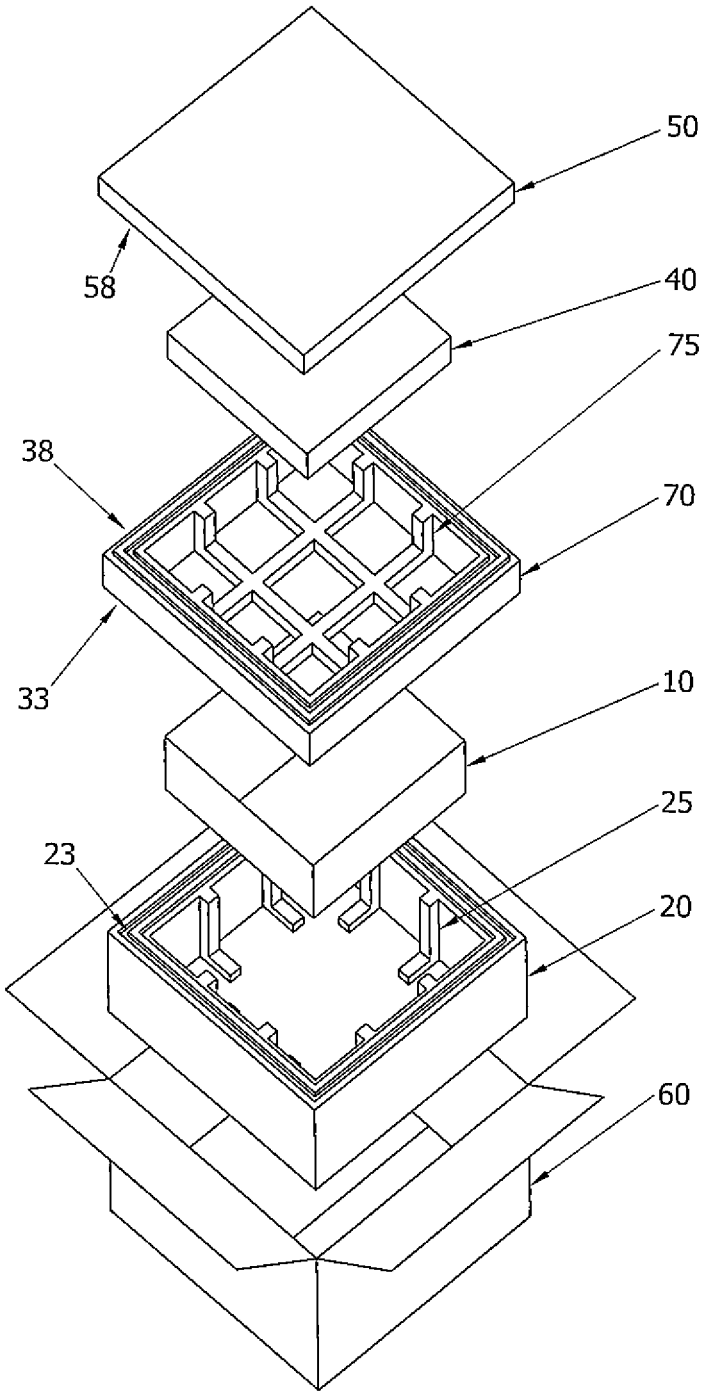
FIG. 10 is an exploded perspective view of a preferred invention featuring an alternative refrigerant collar.

In an alternative embodiment, the container system may be designed to support different refrigerants. For example, where the refrigerant used may be subject to physical degradation over time or where the refrigerant is not a foam or rigid refrigerant, such as an ice filled plastic bag, alternative refrigerant collar supports may be used to maintain the refrigerant suspended above the payload. As shown in FIG. 10, one possible alternative refrigerant collar 70 is shown. FIG. 10 shows a refrigerant collar 70 with supports 75 that span the entire length of the refrigerant collar 70 in a grid-like fashion. As such, the grid design of this refrigerant collar 70 can support non-rigid refrigerants yet continue to suspend the refrigerant above the payload without substantially compromising the amount of refrigerant surface area exposed to the air filled space. Whether the supports used are limited to a particular number, size, or type of material has not been found to be important so long as the refrigerant collar is designed such that substantial amounts of a refrigerant's surface area is exposed to the air filled space.

In an alternative embodiment, the supports are not attached to either the refrigerant collar or container base. In this embodiment, the spacers and supports may be part of either or both the refrigerant or the payload itself. And in yet another embodiment, the supports may be independent of any other part of the container system and simply placed into the container system according to the particular design of the shipper. The spacers and supports may be made of insulating or non-insulating materials.

In yet another embodiment of the container system, a system may be designed in which there is no refrigerant collar. In this embodiment the spacers and supports for the refrigerant may be built into the base container, integral to the refrigerant, or simply placed as separate units into the base container above and next to the payload. In this embodiment, the base container would contain a cooperating fit with the lid component of the container system.

Also disclosed are methods of shipping temperature sensitive goods and products according to the container system disclosed herein. As distribution costs rise, shippers are constantly faced with increasing the efficiency and effectiveness of their distribution systems. To that end, the container system disclosed herein can be effectively used in a distribution system to reduce labor, material, and construction costs. According to one aspect of the container system, a method wherein the refrigerant is pre-packed may be employed whereby the refrigerant is packed into the refrigerant collar prior to assembly or packaging of the base container. According to this method, and depending on the specific requirements of a shipper, a variety of refrigerants may be packed and readily available for selection by a shipper. At the time of shipping, the assembler may make determinations about the type of refrigerant needs depending on the estimated length of shipment, the temperature requirements of the payload, and/or other factors. At that time, the shipper may select the pre-packed refrigerant collar to meet its shipping requirements. Accordingly, at the time of shipping, automated or non-automated systems may be used to select refrigerant collars according to certain parameters, such as phasing temperature, size, etc., specifically for the payload being shipped. This method provides a shipper with a great degree of flexibility when packing container systems by allowing it to specifically tailor each shipped container system.

Alternatively, a shipper may pre-pack base containers. In this embodiment, the base containers may be packed with their payloads in a separate facility or at a much earlier time prior to assembly of the container system. This would allow, for example, a shipper to pre-pack the base container under refrigerated conditions at a separate location. When desired, one or more of the pre-packed base containers may be moved to a different location to have the container system finished prior to shipping.

While the invention herein disclosed has been described by means of specific embodiments and applications thereof, numerous modifications and variations can be made thereto by those skilled in the art without departing from the scope of the invention as set forth in the claims.

What is claimed is:

1. An insulated shipping container for transferring a temperature sensitive product therein, the container comprising:

a substantially hollow insulated body having inner walls defining an internal air filled space and outer walls, at least a portion of the inner walls defining a payload cavity, the payload cavity having a shape configured to receive a payload box therein, wherein the payload box has a surface area and wherein the payload cavity is configured to receive at least one support configured and arranged to space the payload box from the inner walls of the insulated body, the at least one support being further configured to expose surface area on all sides of the payload box to the internal air filled space to facilitate heat transfer;

wherein at least a portion of the inner walls of the insulated body further defines at least one heat transfer element cavity at least one of which is positioned in the insulated body over the payload cavity having a shape configured to receive at least one heat transfer element therein, wherein the heat transfer element has a surface area and wherein the heat transfer element cavity is configured and arranged to space the heat transfer element from the payload box and to expose surface area of the heat transfer element to the internal air filled space to facilitate heat transfer.

2. The insulated shipping container of claim 1, wherein the heat transfer element cavity is configured to receive a rigid or foam refrigerant.

3. The insulated shipping container of claim 1 further comprising a lid.

4. The insulated shipping container of claim 1 further comprising a closure for enclosing the insulated body.

5. A shipping system comprising:

a payload box, wherein the payload box has a surface area;

container supports configured to contact the payload box and space the payload box from sidewalls of an insulated container into which the payload box is packed, thereby exposing the surface area on all sides of the payload box to an air filled space in the insulated container to facilitate heat transfer; and at least one heat transfer element, wherein the heat transfer element has a surface area and wherein at least one of the heat transfer elements is configured to be positioned over and spaced from the payload box in the insulated container, so as to expose the surface area of the heat transfer element to the air filled space of the shipping system to facilitate heat transfer.

6. The shipping system of claim 5, further comprising a lid.

7. The shipping system of claim 5, wherein the heat transfer element cavity is configured to receive a rigid or foam refrigerant.

8. The shipping system of claim 5, comprising a closure method.

* * * * *